US007563046B2

(12) United States Patent
Patel

(10) Patent No.: US 7,563,046 B2
(45) Date of Patent: Jul. 21, 2009

(54) FLUID DISPENSERS HAVING REMOVABLY ATTACHED DUAL APPLICATOR ASSEMBLY

(75) Inventor: Amar A. Patel, Arlington Heights, IL (US)

(73) Assignee: Sanford, L.P., Oak Brook, IL (US)

( * ) Notice: Subject to any disclaimer, the term of this patent is extended or adjusted under 35 U.S.C. 154(b) by 539 days.

(21) Appl. No.: 11/122,442

(22) Filed: May 5, 2005

(65) Prior Publication Data

US 2005/0249538 A1 Nov. 10, 2005

Related U.S. Application Data

(60) Provisional application No. 60/568,913, filed on May 7, 2004.

(51) Int. Cl.
*A45D 33/00* (2006.01)
*A46B 11/00* (2006.01)

(52) U.S. Cl. ..... 401/130; 401/126; 401/122

(58) Field of Classification Search ..... 401/16–18, 401/129, 126, 36, 26, 130, 122
See application file for complete search history.

(56) References Cited

U.S. PATENT DOCUMENTS

| | | | | |
|---|---|---|---|---|
| 1,028,704 | A | 4/1912 | Gardner | |
| 1,336,119 | A | 4/1920 | Andersen | |
| 1,353,625 | A | 9/1920 | Brandenburg | |
| 1,868,416 | A | 7/1932 | Hill | 401/185 |
| 1,925,140 | A | 9/1933 | Gardiner | 132/73 |
| 2,070,953 | A | 2/1937 | Morgan | 91/62.6 |
| 2,590,329 | A | 3/1952 | Kromray | 132/79 |
| 2,869,162 | A | 1/1959 | Dritz | 401/26 |
| 2,887,708 | A | 5/1959 | Kane | 15/136 |
| 2,930,062 | A | 3/1960 | Reimann | 15/132.7 |
| 2,964,045 | A | 12/1960 | Otto et al. | 132/85 |
| 3,000,355 | A | 9/1961 | Rosenthal | 120/42.4 |
| 3,341,884 | A | 9/1967 | Pryor | 401/129 |
| 3,377,124 | A | 4/1968 | Matsumoto | 401/198 |
| 3,572,954 | A | 3/1971 | Cheron | 401/18 |

(Continued)

FOREIGN PATENT DOCUMENTS

DE 3044223 12/1981

(Continued)

OTHER PUBLICATIONS

International Search Report for PCT/US2005/015610, mailed May 8, 2006, 2 pages.

(Continued)

*Primary Examiner*—David J Walczak
(74) *Attorney, Agent, or Firm*—Marshall, Gerstein & Borun LLP

(57) ABSTRACT

A fluid dispenser includes a container defining a fluid reservoir and having an opening and a dual applicator assembly removably attached to the container. The dual applicator assembly includes a cap adapted to substantially seal the opening. A writing point is disposed in the cap and a stem is coupled to the cap. The stem has first and second ends and includes a channel through the first end. The channel defines a fluid passageway between the writing point and the fluid reservoir. Finally, an applicator is coupled to the second end of the stem.

21 Claims, 4 Drawing Sheets

U.S. PATENT DOCUMENTS

| | | | | |
|---|---|---|---|---|
| 3,688,450 | A | 9/1972 | Brockman | 51/181 |
| 4,089,994 | A | 5/1978 | Mattsson et al. | 427/140 |
| 4,156,657 | A | 5/1979 | Lin | 252/188.3 R |
| 4,198,172 | A | 4/1980 | Meislik | 401/214 |
| 4,251,572 | A | 2/1981 | Herliczek et al. | 427/142 |
| 4,472,462 | A | 9/1984 | Apice et al. | 427/288 |
| 4,522,523 | A | 6/1985 | Vogelsang | 401/126 |
| 4,600,327 | A | 7/1986 | Guzman | 401/18 |
| 4,610,556 | A | 9/1986 | Tsai | 401/18 |
| 4,936,498 | A | 6/1990 | Pirilä | 222/420 |
| 5,044,804 | A | 9/1991 | Chuang | 401/34 |
| D321,717 | S | 11/1991 | Hager | D19/36 |
| D322,516 | S | 12/1991 | Korper | D4/121 |
| 5,620,270 | A | 4/1997 | Gueret | 401/126 |
| 5,651,627 | A | 7/1997 | Dowzall et al. | 401/199 |
| 5,746,529 | A | 5/1998 | Peters et al. | 401/18 |
| D396,884 | S | 8/1998 | Davila | D19/36 |
| 5,791,798 | A | 8/1998 | Yu | 401/57 |
| 5,813,787 | A | 9/1998 | Dowzall et al. | 401/199 |
| 5,881,742 | A | 3/1999 | Hunsberger | 132/297 |
| 5,913,630 | A | 6/1999 | Kelders et al. | 401/126 |
| 6,059,474 | A * | 5/2000 | Huang | 401/16 |
| 6,065,477 | A | 5/2000 | Doo | 132/73 |
| 6,126,349 | A | 10/2000 | Kelders | 401/36 |
| 6,149,330 | A | 11/2000 | Chuang | 401/57 |
| 6,183,155 | B1 | 2/2001 | Kaufmann | 401/199 |
| 6,213,660 | B1 | 4/2001 | Waller et al. | 401/24 |
| 6,712,537 | B2 * | 3/2004 | Hung | 401/16 |
| 6,776,548 | B2 | 8/2004 | Gardner, Jr. et al. | 401/18 |
| 6,991,395 | B1 * | 1/2006 | Huang | 401/17 |
| 2003/0063942 | A1 | 4/2003 | Gardner, Jr. et al. | 401/16 |
| 2003/0152410 | A1 | 8/2003 | Huang | 401/19 |

FOREIGN PATENT DOCUMENTS

| | | |
|---|---|---|
| DE | 202 03 845 U | 7/2003 |
| GB | 349106 | 5/1931 |
| GB | 1315639 | 5/1973 |
| JP | 2-158399 | 6/1990 |
| JP | 2000-210612 | 8/2000 |
| JP | 2002-225495 | 8/2002 |
| WO | WO 89/07053 | 8/1989 |
| WO | WO 93/10984 | 6/1993 |
| WO | WO 93/17879 | 9/1993 |
| WO | WO 95/20496 | 8/1995 |
| WO | WO 95/20497 | 8/1995 |
| WO | WO 03/028902 | 4/2003 |

OTHER PUBLICATIONS

Written Opinion of the International Searching Authority for PCT/2005/015610, mailed May 8, 2006, 5 pages.
Undated Yamayo Correction Pen and Fluid products publication (1 page).
Undated Bibianco Duo correction instruments publication (2 pages).

* cited by examiner

FLUID DISPENSERS HAVING REMOVABLY ATTACHED DUAL APPLICATOR ASSEMBLY

CROSS-REFERENCE TO RELATED APPLICATIONS

The benefit under 35 U.S.C. §119(e) of U.S. provisional patent application Ser. No. 60/568,913 filed May 7, 2004, the entire disclosure of which is incorporated herein by reference, is claimed.

FIELD OF THE DISCLOSURE

The disclosure generally relates to fluid dispensers, and more particularly to fluid dispensers comprising a container having an opening and a dual applicator assembly removably attached to the container.

BACKGROUND OF THE DISCLOSURE

Dispensers for fluids such as correction fluids, inks, paints, and the like are generally well-known. A typical fluid dispenser for a correction fluid comprises a bottle and a cap for sealing the bottle. The cap often includes an applicator such as a plurality of brush bristles attached to an end of a stem projecting from an underside of the cap. The applicator can generally be positioned in contact with a fluid contents of the bottle, and therefore used to apply the contained fluid to a substrate.

Similar fluid dispensers have been incorporated into the bodies of writing instruments. For example, U.S. Design Pat. Nos. 321,717 and 396,884, U.S. Pat. No. 4,600,327, and JP 2-158399 disclose writing instruments including a writing point and a fluid reservoir generally opposite the writing point. In each of these writing instrument systems, there is not a defined fluid passageway from the fluid reservoir to the writing point. Therefore, the writing point and the applicator can not both be used to apply the contained fluid to a substrate.

Fluid dispensers having a defined fluid passageway from the fluid reservoir to the writing point are also known. In such known fluid dispensers, both the applicator and the writing point can be used to apply the fluid contained in the fluid reservoir to a substrate. However, after inverting the fluid dispenser, for example, to use the writing point to make a written mark, the fluid can collect at locations along the fluid passageways as it travels from and returns to the fluid reservoir. The collected fluid can dry and clog the fluid passageways, thereby making such fluid dispensers generally inadequate for consumer use. The aforementioned clogging problem is particularly exacerbated when such fluid dispensers contain viscous fluids that readily dry to provide a solid residue, such as correction fluids.

SUMMARY OF THE DISCLOSURE

Fluid dispensers in accordance with the disclosure generally comprise a container having an opening and a dual applicator assembly removably attached to the container. The fluid dispensers advantageously comprise a fluid passageway between a writing point and a fluid reservoir that essentially eliminates clogging along the fluid passageway. Moreover, the channel facilitates the return of a fluid from the writing point to the fluid reservoir, for example, after use of the fluid dispenser writing point.

In one embodiment according to the disclosure, a fluid dispenser comprises a container defining a fluid reservoir and having an opening, and a dual applicator assembly removably attached to the container, the dual applicator assembly comprising a cap adapted to substantially seal the opening, a writing point disposed in the cap, a stem coupled to the cap, the stem having first and second ends and including a channel through the first end, the channel defining a fluid passageway between the writing point and the fluid reservoir, and an applicator coupled to the second end.

In an additional embodiment according to the disclosure, a fluid dispenser comprises a container defining a fluid reservoir, the container including a neck providing an opening and a wiper insert coupled to the neck, and a dual applicator assembly removably attached to the container, the dual applicator assembly comprising a cap adapted to substantially seal the opening, a writing point projecting from the cap along an axis, a stem coupled to the cap, and an applicator coupled to the stem, wherein the fluid passageway is unrestricted along at least a portion of the axis.

BRIEF DESCRIPTION OF THE DRAWINGS

Exemplary aspects and features of fluid dispensers in accordance with the disclosure are described and explained in greater detail below with the aid of the drawing figures in which.

DETAILED DESCRIPTION OF THE DISCLOSURE

Figure 1:
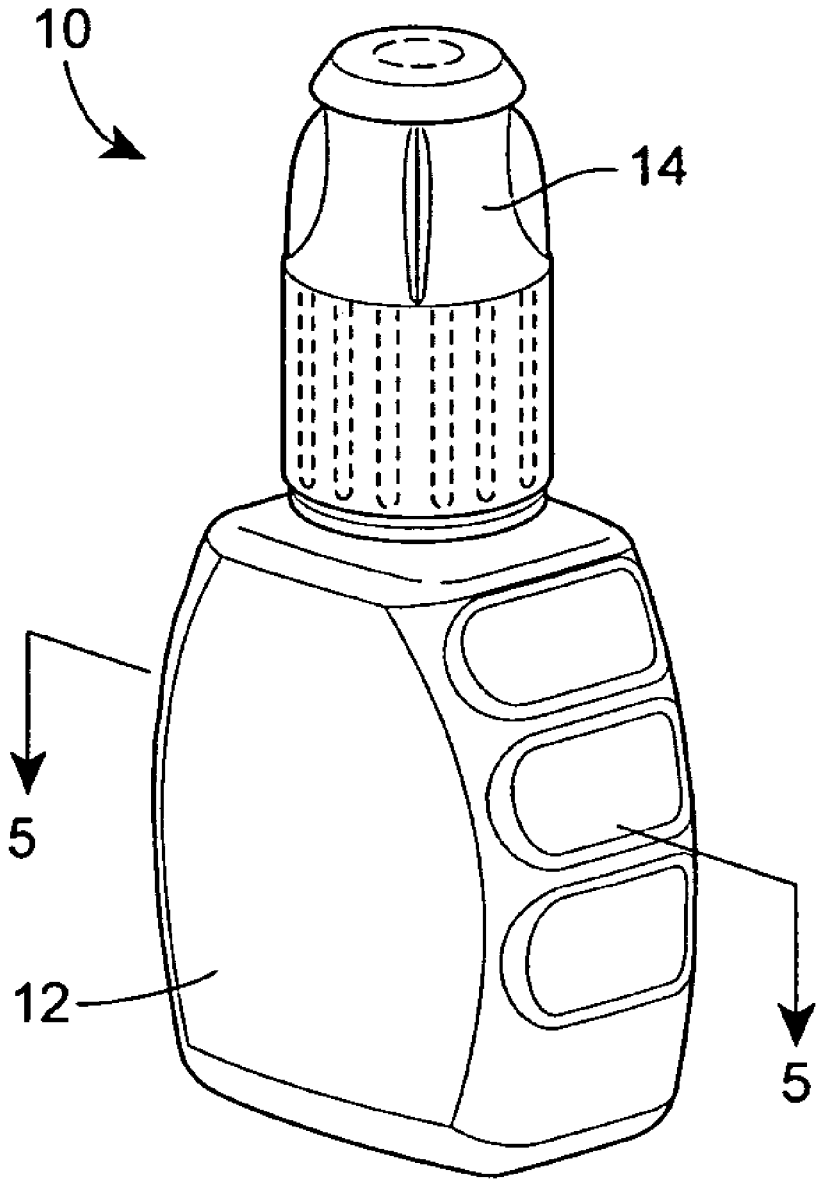
FIG. 1 is a perspective view illustrating a fluid dispenser in accordance with the disclosure.
Figure 2:
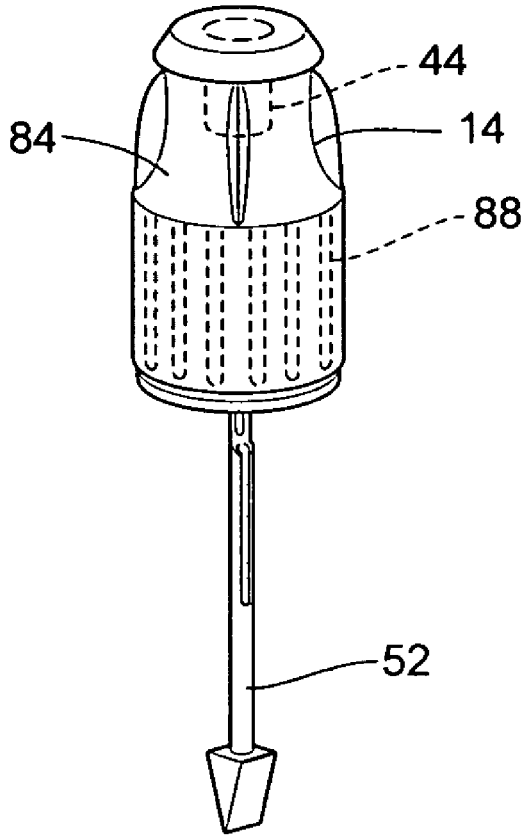
FIG. 2 is a perspective view of a dual applicator assembly in accordance with the disclosure.

The fluid dispensers in accordance with the disclosure generally comprise a container having an opening and a dual applicator assembly removably attached to the container. The dual applicator assembly advantageously allows users to apply a contained fluid with two different application means, each of which is adapted for making particular types of markings. Additionally, the fluid dispensers comprise a fluid passageway between a writing point and a fluid reservoir that essentially eliminates clogging along the fluid passageway, even when the containers are filled with viscous fluids that readily dry to provide a solid residue, such as correction fluids. An additional benefit of the disclosed fluid dispensers is that the fluid passageway facilitates the return of a fluid from the writing point to the fluid reservoir, for example, after use of the fluid dispenser writing point. Other benefits and features of the disclosed fluid dispensers are described in more detail below.

Throughout FIGS. 1-5, a fluid dispenser in accordance with the disclosure is generally shown as fluid dispenser 10. Fluid dispenser 10 includes a container 12 and a dual applicator assembly 14.

Container 12 can suitably be any container defining a fluid reservoir 16 and having an opening 18. Container 12 generally includes a bottom surface 20 from which a perimeter side wall 22 upwardly extends. In the illustrated embodiment, container 12 also includes a plurality of finger grip surfaces 24, which facilitate a user's ability to grasp, manipulate, and use fluid dispenser 10, for example, to make written marks. At least a portion (not shown) of container 12 can be textured to further augment the user's ability to controllably apply fluid to a surface with fluid dispenser 10.

Container 12 can be of any suitable shape and/or configuration provided that container 12 is adapted to store a liquid and has an opening to receive dual applicator assembly 14. While container 12 is mostly described herein for use in conjunction with correction fluids, it is understood that container 12 may alternatively contain any type of material adapted to be applied to a surface for the correction, decoration, or protection thereof, including correction fluids, inks, paints, and the like.

Figure 3:
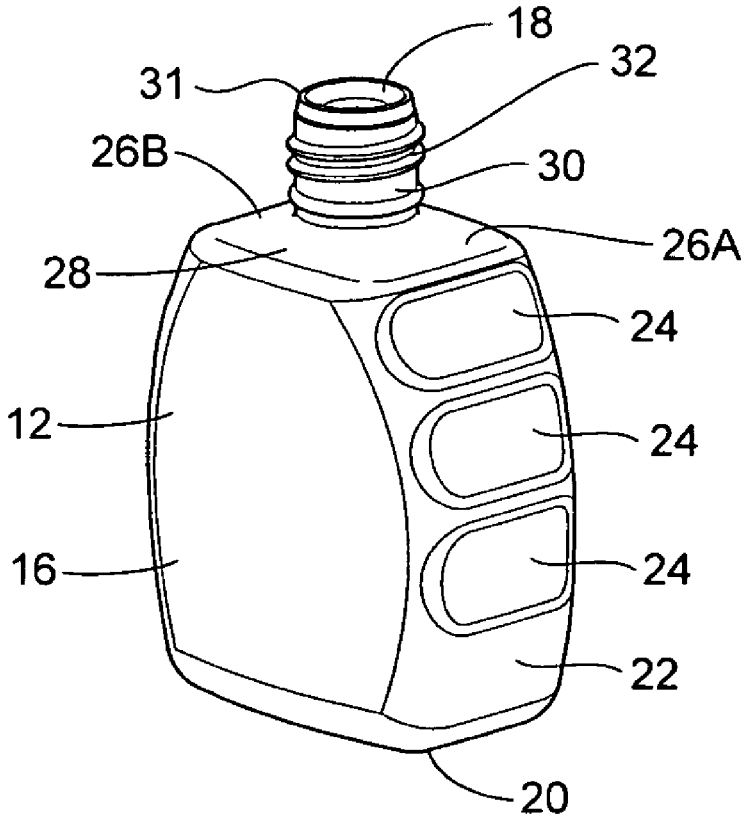
FIG. 3 is a perspective view of a container in accordance with the disclosure.
Figure 4:
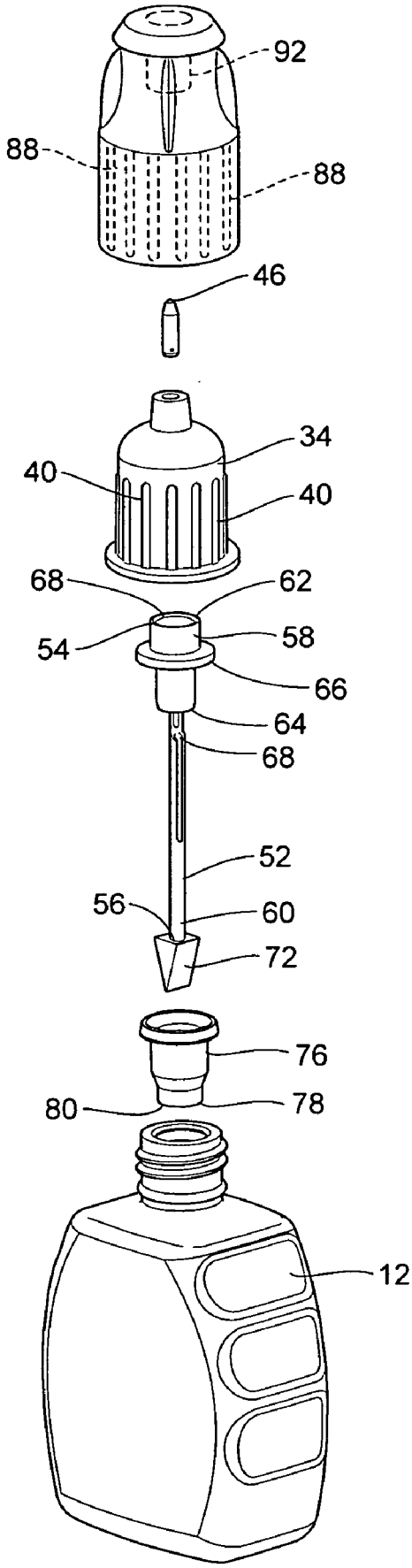
FIG. 4 is an exploded view of the fluid dispenser shown in FIG. 1.

Container side wall 22 generally terminates at shoulders 26A and 26B, which provide shoulder surface 28 from which a neck 30 extends (see FIG. 3). Neck 30 defines opening 18, which provides access to fluid reservoir 16 of container 12, and generally terminates at a top container surface 31. Containers having openings 18 in different positions (i.e., not at the top of the container) may also be used. As illustrated, neck 30 has a threaded exterior surface 32 to facilitate attachment of dual applicator assembly 14 to container 12, as described below. Alternatively, a bead (not shown) can be provided about the circumference of neck 30 to facilitate attachment of container 12 to dual applicator assembly 14 to provide a snap-fit interference engagement, as described in more detail below.

In FIG. 1, the dual applicator assembly 14 is shown attached to the container 12. With specific reference to FIGS. 2 and 3, dual applicator assembly 14 can also be removed from the container 12. Thus, dual applicator assembly 14 is removably attached to the container 12.

Dual applicator assembly 14 generally includes a cap 34 adapted to substantially seal opening 18. With specific reference to FIG. 5, cap 34 typically includes an interior wall 36 having grooves 38 for receiving threaded exterior surface 32 of neck 30. Thus, cap 34 can substantially seal container 12 by a conventional threaded engagement. Such a threaded engagement allows the user to quickly remove dual applicator assembly 14 from container 12 to access and use the fluid contents of container 12.

Other mechanisms may also be used to attach cap 34 of dual applicator assembly 14 to container 12. For example, in one embodiment, dual applicator assembly 14 comprises a cap 34 including an annular channel or groove (not shown) for releasably receiving a bead (not shown) on neck 30 of container 12. The annular channel can include a plurality of tabs or ribs (not shown) that are adapted to interact with the bead (not shown) to provide a snap-fit interference engagement between cap 34 and container 12, thereby substantially sealing cap 34 to container 12. Additionally, threads can be formed on the inside of cap 34, and corresponding grooves can be formed on the outside surface of neck 30.

Cap 34 can also include a plurality of splines 40, which are described in more detail below. Additionally, interior top surface 42 of cap 34 can include an annular channel 44, which is also described in more detail below.

Typically, a writing point 46 is disposed in the cap 34. In a preferred embodiment, writing point 46 projects from cap 34 along a central axis 48 of fluid dispenser 10. The writing point 46 may generally be any suitable writing point, including but not limited to ball points, pin valves, rigid nibs, and porous nibs. Ball points are typically preferred because they do not drag across the substrate when the writing point 46 is applied to a substrate to make a written mark. In the exemplary embodiment of the figures, the writing point is a double ball point 50 (see FIG. 5).

Dual applicator assembly 14 also includes a stem 52 coupled to cap 34. As depicted throughout the figures, stem 52 and cap 34 are separate parts. Alternatively, stem 52 and cap 34 can be of integral, unitary construction.

Stem 52 has first and second ends 54, 56. Stem 52 generally comprises a hollow barrel portion 58 at first end 54, and a solid cylindrical portion 60 at second end 56. Hollow barrel portion 58 comprises a top edge 62, a bottom edge 64, and a collar 66 disposed between top and bottom edges 62, 64, for engaging top container surface 31. This allows top edge 62 of hollow barrel portion 58 to be received by annular channel 44 to couple stem 52 to cap 34.

Stem 52 typically includes a channel 68 through the first end 54. Channel 68 defines a fluid passageway 70 between the writing point 46 and the fluid reservoir 16. With specific reference to FIG. 5, fluid passageway 70 is unrestricted along at least a portion of the central axis 48, as is described in more detail below.

Dual applicator assembly 14 further includes an applicator 72 coupled to stem 52. Although applicator 72 is exemplified in the figures as a foam applicator 74, a number of applicators can be used. For example, applicator 72 can comprise a plurality of brush bristles (not shown).

Typically, container 12 includes a wiper insert 76 coupled to neck 30. As depicted throughout the figures, wiper insert 76 and container 12 are separate parts. Alternatively, wiper insert 76 and container 12 can be of integral, unitary construction. Wiper insert 76 provides an applicator wiping surface 78 at a bottom edge 80 thereof. Additionally, bottom edge 80 of wiping insert 76 restricts fluid flow through opening 18, for example, when container 12 is knocked over. Wiper insert 76 also helps to minimize evaporation loss of the fluid contents contained in container 12.

Figure 5:
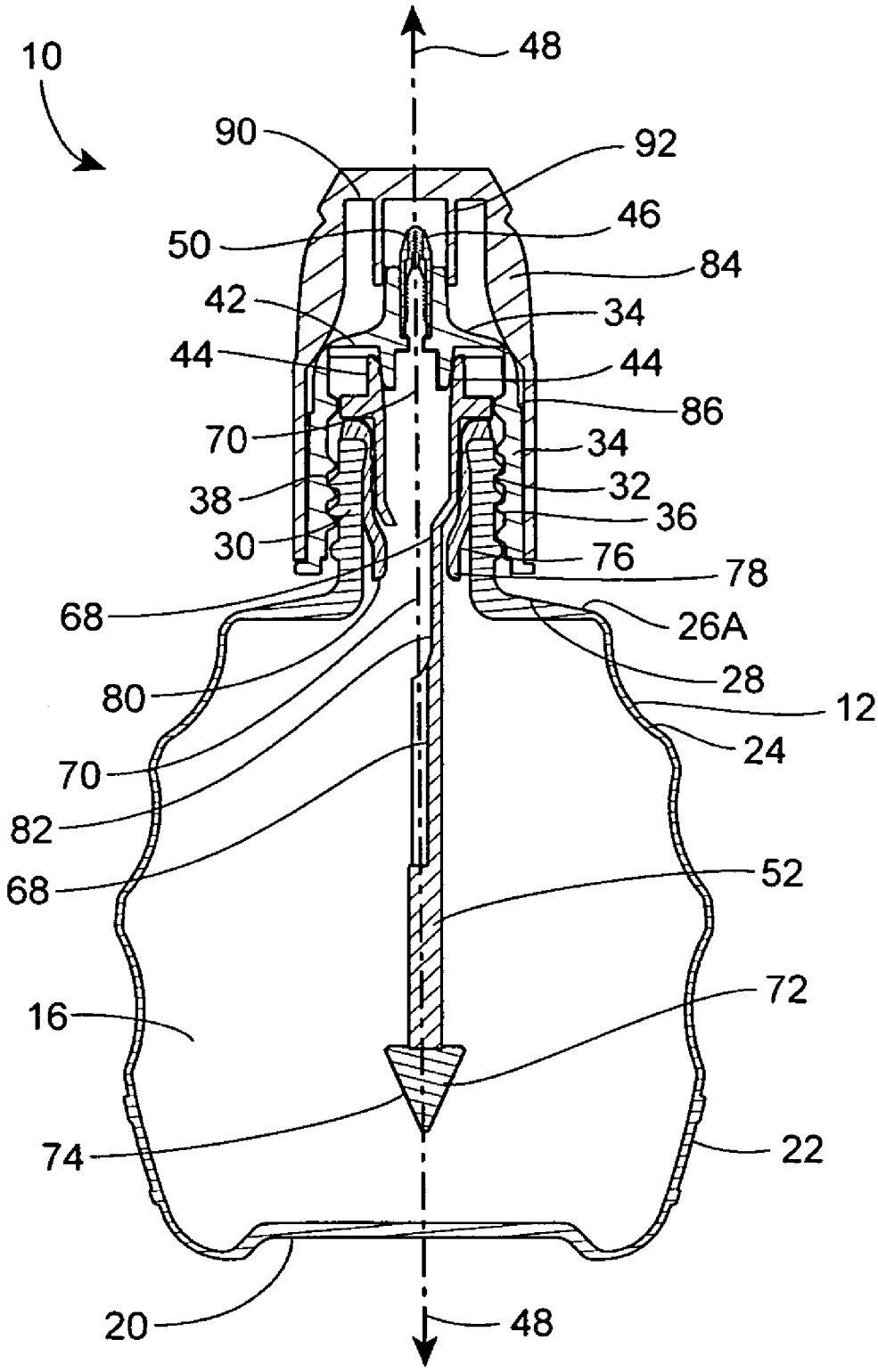
FIG. 5 is a cross-sectional view along line 5-5' of the fluid dispenser shown in FIG. 1.

With reference to FIG. 5, it can be seen that fluid passageway 70 is unrestricted between wiper insert bottom edge 80 and writing point 46. The unrestricted nature of fluid passageway 70 essentially eliminates the clogging of any contained fluid along fluid passageway 70, even when container 12 is filled with a viscous fluid that readily dries to provide a solid residue, such as a correction fluid. Additionally, fluid passageway 70 facilitates the return of a fluid from writing point 46 to fluid reservoir 16, for example, after inverting fluid dispenser 10 to use writing point 46 to make a written mark.

Again, with reference to FIG. 5, it can be seen that a portion 82 of channel 68 extends beyond bottom edge 80 of wiper insert 76. Channel portion 82 helps to collect and direct the fluid contents of container 12 along fluid passageway 70. Channel portion 82 has a cross-sectional area reduced by at least about 25 percent, more preferably reduced by at least about 33 percent, most preferably reduced by at least about 50 percent, relative to a non-reduced portion of stem 52 such as solid cylindrical portion 60 at second end 56.

Dual applicator assembly 14 can further comprise a second cap 84. Second cap 84 has an interior wall 86 including a plurality of grooves 88 for engaging the plurality of splines 40, thereby facilitating removal of dual applicator assembly 14. The plurality of grooves 88 are generally depicted in phantom throughout FIGS. 1-4. Additionally, an interior top surface 90 of second cap 84 includes an annular wall 92 for enclosing writing point 46 to help prevent the leakage of fluid from writing point 46. Annular wall 92 is shown in phantom in FIGS. 1-4, and is also shown in cross section in FIG. 5. Second cap 84 can also include an interior protruding snap ring (not shown) for engaging bumps (also not shown) disposed on the exterior of cap 34 (for example, spines 40) in order to provide a snap fit between cap 34 and second cap 84.

The various components of the fluid dispensers 10 can be manufactured through a variety of methods including, without limitation, injection molding, injection stretch blow molding, thermoforming, extrusion blow molding, injection blow molding, insert molding, co-injection molding, rotational molding, and other methods known in the art. Injection blow molding is a preferred method for manufacturing the containers in accordance with the disclosure. Injection molding is a preferred method for manufacturing the dual applicator assembly and the wiper insert in accordance with the disclosure.

A variety of thermoplastic resins can be used to manufacture the fluid dispensers, including polyethylenes (e.g., high density polyethylene or linear low density polyethylene), polypropylenes (including structural foam comprising polypropylene), polyethylene terephthalates, polyvinyl chlorides, polycarbonates, and barrier resins such as acrylonitrile butadiene styrene copolymer and acrylonitrile methyl acrylate copolymer. An important consideration for thermoplastic resin selection is the nature of the fluid contained in the container, and thus the amount of solvent resistance required. Acrylonitrile methyl acrylate copolymer is an exemplary material for container construction. Polypropylene is a preferred material for manufacture of the dual applicator assembly and the wiper insert. Additionally, various thermoplastic elastomers, such as Santoprene® products (Advanced Elastomer Systems, L.P., Akron, Ohio), can be used to provide rubbery gripping surfaces on the exterior of the containers and caps in accordance with the disclosure.

Although the foregoing text sets forth a detailed description of numerous different embodiments of fluid dispensers in accordance with the disclosure, it should be understood that the detailed description is to be construed as exemplary only and does not describe every possible embodiment of such fluid dispensers.

What is claimed is:

1. A fluid dispenser comprising:

a container defining a fluid reservoir and having an opening; and, a dual applicator assembly removably attached to the container, the dual applicator assembly comprising:

(a) a cap adapted to substantially seal the opening;

(b) a writing point disposed in the cap;

(c) a stem coupled to the cap, the stem having first and second ends, the first end including a channel adapted to collect and direct a fluid along a fluid passageway between the writing point and the fluid reservoir, the second end including a cylindrical portion having an entirely solid cross-section;

(d) an applicator coupled to the cylindrical portion of the stem; and (e) a wiper insert coupled to a neck of the container, the wiper insert having an applicator wiping surface at a bottom edge, and wherein a portion of the channel extends beyond the bottom edge of the wiper insert.

2. The fluid dispenser of claim 1, wherein the fluid passageway is unrestricted between the bottom edge and the writing point.

3. The fluid dispenser of claim 1, wherein the channel portion has a cross-sectional area reduced by at least about 25 percent relative to the cylindrical portion of the stem.

4. The fluid dispenser of claim 1, wherein the neck of the container further comprises a threaded exterior surface and the cap includes an interior wall having grooves for receiving the threaded exterior surface and substantially sealing the cap to the container.

5. The fluid dispenser of claim 1, wherein the cap includes a plurality of splines, and the dual applicator assembly further comprises a second cap having an interior wall including a plurality of grooves for engaging the plurality of splines and removing the dual applicator assembly.

6. The fluid dispenser of claim 5, wherein an interior top surface of the second cap includes an annular wall for enclosing the writing point.

7. The fluid dispenser of claim 1, wherein the writing point is selected from the group consisting of a ball point, a porous nib, and a rigid nib.

8. The fluid dispenser of claim 1, wherein the first end of the stem further comprises a hollow barrel portion.

9. The fluid dispenser of claim 8, wherein the hollow barrel portion comprises a top edge, a bottom edge, and a collar for engaging a top surface of the container disposed between the top and bottom edges.

10. The fluid dispenser of claim 8, wherein an interior top surface of the cap provides an annular channel for receiving the top edge of the hollow barrel, thereby coupling the stem to the cap.

11. The fluid dispenser of claim 1, wherein the applicator is selected from the group consisting of a plurality of brush bristles and a foam applicator.

12. A fluid dispenser comprising:

a container defining a fluid reservoir, the container including a neck providing an opening and a wiper insert coupled to the neck; and, a dual applicator assembly removably attached to the container, the dual applicator assembly comprising:

(a) a cap adapted to substantially seal the opening;

(b) a writing point projecting from the cap along an axis;

(c) a fluid passageway between the writing point and the fluid reservoir;

(d) a stem coupled to the cap, wherein the stem includes a first end and a second end, the first end having a channel adapted to collect and direct fluid along the fluid passageway, a portion of the channel extending beyond a bottom edge of the wiper isert, the second end having a cylindrical portion having an entirely solid cross-section; and, (e) an applicator coupled to the cylindrical portion of the stem, wherein the fluid passageway is unrestricted along at least a portion of the axis.

13. The fluid dispenser of claim 12, wherein the fluid passageway is unrestricted between the bottom edge of the wiper insert and the writing point.

14. The fluid dispenser of claim 12, wherein a portion of the channel has a cross-sectional area reduced by at least about 25 percent relative to the cylindrical portion of the stem.

15. The fluid dispenser of claim 12, wherein the cap includes a plurality of splines, and the dual applicator assembly further comprises a second cap having an interior wall including a plurality of grooves for engaging the plurality of splines.

16. The fluid dispenser of claim 15, wherein an interior top surface of the second cap includes an annular wall for enclosing the writing point.

17. The fluid dispenser of claim 12, wherein the writing point is selected from the group consisting of a ball point, a porous nib, and a rigid nib.

18. The fluid dispenser of claim 12, wherein the stem further comprises a hollow barrel portion at the first end.

19. The fluid dispenser of claim 18, wherein the hollow barrel portion comprises a top edge, a bottom edge, and a collar for engaging a top surface of the container, the collar disposed between the top and bottom edges.

20. The fluid dispenser of claim 18, wherein an interior top surface of the cap provides an annular channel for receiving the top edge of the hollow barrel.

21. The fluid dispenser of claim 12, wherein the applicator is selected from the group consisting of a plurality of brush bristles and a foam applicator.

* * * * *

UNITED STATES PATENT AND TRADEMARK OFFICE

CERTIFICATE OF CORRECTION

PATENT NO. : 7,563,046 B2
APPLICATION NO. : 11/122442
DATED : July 21, 2009
INVENTOR(S) : Amar A. Patel It is certified that error appears in the above-identified patent and that said Letters Patent is hereby corrected as shown below:

In the Claims:

At Column 6, line 32, "isert" should be -- insert --.

Signed and Sealed this

Sixteenth Day of February, 2010

David J. Kappos

David J. Kappos
*Director of the United States Patent and Trademark Office*